US009660373B2

(12) United States Patent
Tsai et al.

(10) Patent No.: US 9,660,373 B2
(45) Date of Patent: May 23, 2017

(54) WATERPROOF ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Rui Su, New Taipei (TW); Long-Fei Chen, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/065,219

(22) Filed: Mar. 9, 2016

(65) Prior Publication Data

US 2016/0268722 A1 Sep. 15, 2016

(30) Foreign Application Priority Data

Mar. 9, 2015 (CN) ..... 2015 1 0101906

(51) Int. Cl.

| | |
|---|---|
| ***H01R 12/00*** | (2006.01) |
| ***H01R 13/52*** | (2006.01) |
| *H01R 24/60* | (2011.01) |
| *H01R 107/00* | (2006.01) |
| *H01R 12/50* | (2011.01) |
| *H01R 12/70* | (2011.01) |

(52) U.S. Cl.

CPC ..... *H01R 13/5202* (2013.01); *H01R 12/7035* (2013.01); *H01R 23/7021* (2013.01); *H01R 24/60* (2013.01); *H01R 2107/00* (2013.01)

(58) Field of Classification Search

CPC ..... H01R 12/7035; H01R 23/7021
USPC ..... 439/79, 567, 607.4
See application file for complete search history.

(56) References Cited

U.S. PATENT DOCUMENTS

| | | | | |
|---|---|---|---|---|
| 2015/0295362 | A1* | 10/2015 | Tziviskos | H01R 13/6581 439/607.01 |
| 2016/0093974 | A1* | 3/2016 | Lai | H01R 13/5202 439/736 |
| 2016/0093994 | A1* | 3/2016 | Chen | H01R 12/724 439/607.01 |

* cited by examiner

*Primary Examiner* — Tho D Ta
(74) *Attorney, Agent, or Firm* — Muncy, Geissler, Olds & Lowe, P.C.

(57) ABSTRACT

A waterproof electrical receptacle connector includes a plastic shell, a metallic shell, an insulated housing, and a buckling member. The plastic shell includes a shell body, a through hole defined in the shell body, and an assembling hole defined on the shell body. The metallic shell is received in the through hole and defines a receiving cavity. The insulated housing is received in the receiving cavity and includes a base portion and a tongue portion extending from the base portion. The buckling member is positioned with the assembling hole and includes a buckling body and a hook extending from the bottom of the buckling body and protruded out of the assembling hole. Accordingly, the hook is protruded out of the assembling hole and engaged with a buckling hole of a circuit board, so that the front of waterproof electrical receptacle connector can be firmly positioned with the circuit board.

19 Claims, 11 Drawing Sheets

| | | | | | | | | | | | |
|---|---|---|---|---|---|---|---|---|---|---|---|
| GND | TX1+ | TX1− | VBUS | CC1 | D+ | D− | RFU | VBUS | RX2− | RX2+ | GND |
| GND | RX1+ | RX1− | VBUS | RFU | D− | D+ | CC2 | VBUS | TX2− | TX2+ | GND |

4

5

Fig. 6

WATERPROOF ELECTRICAL RECEPTACLE CONNECTOR

CROSS-REFERENCES TO RELATED APPLICATIONS

This non-provisional application claims priority under 35 U.S.C. §119(a) on Patent Application No. 201510101906.7 filed in China, P.R.C. on Mar. 9, 2015, the entire contents of which are hereby incorporated by reference.

FIELD OF THE INVENTION

The instant disclosure relates to an electrical receptacle connector, and more particular to a waterproof electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, micro USB interconnects are developed which include advantageous like small occupation volume and ease of portability. Therefore, the micro USB interconnects are widely adopted to smart mobile devices, digital cameras, or other portable electronic devices to mate with connecting cables for data transmission or power supply.

An existing USB type-C electrical receptacle connector includes an insulated housing, a plurality of first terminals, a plurality of second terminals, and a hollowed shell. The insulated housing includes a base portion and a tongue portion extending from one side of the base portion. The first terminals and the second terminals are held in the base portion and the tongue portion. The front of each of the first terminals is disposed at an upper surface of the tongue portion, the front of each of the second terminals is disposed at a lower surface of the tongue portion, and the rear of each of the first terminals and the second terminals is protruded from the base portion for positioned on a circuit board.

However, the electrical receptacle connector is positioned with the circuit board by the rear thereof, and the front of the electrical receptacle connector is devoid of a strengthening structure for positioning with the circuit board. As a result, when the electrical receptacle connector is bent due to an impact force, the opening of the electrical receptacle connector for mating with an electrical plug connector is not aligned with the opening of an electronic device for receiving the electrical receptacle connector. Therefore, a user cannot mate the electrical plug connector with the electrical receptacle connector.

SUMMARY OF THE INVENTION

Consequently, how to improve the existing connector becomes an issue.

In view of this, an exemplary embodiment of the instant disclosure provides a waterproof electrical receptacle connector which can be firmly positioned with a circuit board. Therefore, the abovementioned issue can be solved.

An exemplary embodiment of the waterproof electrical receptacle connector comprises a plastic shell, a metallic shell, an insulated housing, a plurality of upper-row receptacle terminals, a plurality of lower-row receptacle terminals, and at least one buckling member. The plastic shell comprises a shell body, a through hole, and at least one assembling hole. The through hole is defined in the shell body, and the assembling hole is defined on the shell body. The metallic shell is received in the through hole and the metallic shell defines a receiving cavity. The insulated housing is received in the receiving cavity. The insulated housing comprises a base portion and a tongue portion extending from one side of the base portion. The tongue portion has an upper surface and a lower surface opposite to the upper surface. The upper-row receptacle terminals comprise a plurality of upper signal pairs, at least one power terminal, and at least one ground terminal. Each of the upper-row receptacle terminals is held in the insulated housing and disposed at the upper surface. The lower-row receptacle terminals comprise a plurality of lower signal pairs, at least one power terminal, and at least one ground terminal. Each of the lower-row receptacle terminals is held in the insulated housing and disposed at the lower surface. The buckling member is positioned with the assembling hole. The buckling member comprises a buckling body and a hook portion extending from the bottom of the buckling body and protruded out of the assembling hole.

In some embodiments, the buckling member comprises a transverse plate. The transverse plate is extending from the top of the buckling body along the width direction of the buckling body and is perpendicular to the buckling body. The shell body comprises an engaging slot communicating with the assembling hole and positioned with the transverse plate.

In some embodiments, the buckling member comprises an engaging block extending outward from the buckling body, and the shell body comprises a protruded block defined in the assembling hole to engage with the engaging block.

In some embodiments, the waterproof electrical receptacle connector further comprises a glue filling member filled in the assembling hole to position with the buckling member.

In some embodiments, the waterproof electrical receptacle connector further comprises a circuit board assembled at the bottom of the plastic shell, wherein the circuit board comprises a buckling hole positioned with the hook portion.

In some embodiments, the waterproof electrical receptacle connector further comprises a first waterproof gasket and a second waterproof gasket. The first waterproof gasket is fitted over the plastic shell. The second waterproof gasket is received in the through hole and abutted between the inner wall of the plastic shell and the outer wall of the metallic shell.

In some embodiments, the waterproof electrical receptacle connector further comprises a sealing member filled in the rear of the plastic shell to fill a gap between the plastic shell and the metallic shell and to fill the bottom of the base portion.

In some embodiments, the upper-row receptacle terminals and the lower-row receptacle terminals have 180 degree symmetrical design with respect to a central point of the receiving cavity as the symmetrical center.

In some embodiments, the position of the upper-row receptacle terminals corresponds to the position of the lower-row receptacle terminals.

In some embodiments, the waterproof electrical receptacle connector further comprises a grounding plate disposed at the insulated housing and between the upper-row receptacle terminals and the lower-row receptacle terminals.

Based on the above, the buckling member is assembled in the assembling hole of the plastic shell, and the hook portion of the buckling member is protruded out of the assembling hole to be engaged with the buckling hole of the circuit board, so that the circuit board can be firmly positioned with the waterproof electrical receptacle connector. Accordingly, when the waterproof electrical receptacle connector suffers an impact force, the waterproof electrical receptacle connector would not be bent. As a result, a user can mate an electrical plug connector with the waterproof electrical receptacle connector inside an electronic device rapidly and conveniently.

In addition, several waterproof gaskets are fitted over the plastic shell and abutted against the inner wall of the electronic device assembled with the waterproof electrical receptacle connector, so that water moist cannot enter into the electronic device through the gaps between the plastic shell and the metallic shell. Moreover, the waterproof gasket is abutted between the inner wall of the plastic shell and the outer wall of the metallic shell to prevent water moist from entering into the connector through the gap between the plastic shell and the metallic shell. Consequently, water moist can be efficiently prevented from entering into the electronic device assembled with the connector.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the waterproof electrical receptacle connector can have a 180 degree symmetrical, dual or double orientation design and pin assignments which enables the waterproof electrical receptacle connector to be mated with a corresponding plug connector in either of two intuitive orientations, i.e. in either upside-up or upside-down directions. Therefore, when an electrical plug connector is inserted into the waterproof electrical receptacle connector with a first orientation, the flat contact portions of the upper-row receptacle terminals are in contact with upper-row plug terminals of the electrical plug connector. Conversely, when the electrical plug connector is inserted into the waterproof electrical receptacle connector with a second orientation, the flat contact portions of the lower-row receptacle terminals are in contact with the upper-row plug terminals of the electrical plug connector. Note that, the inserting orientation of the electrical plug connector is not limited by the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 6 illustrates a schematic configuration diagram of the receptacle terminals of the waterproof electrical receptacle connector shown in FIG. 5;

DETAILED DESCRIPTION

Figure 1:
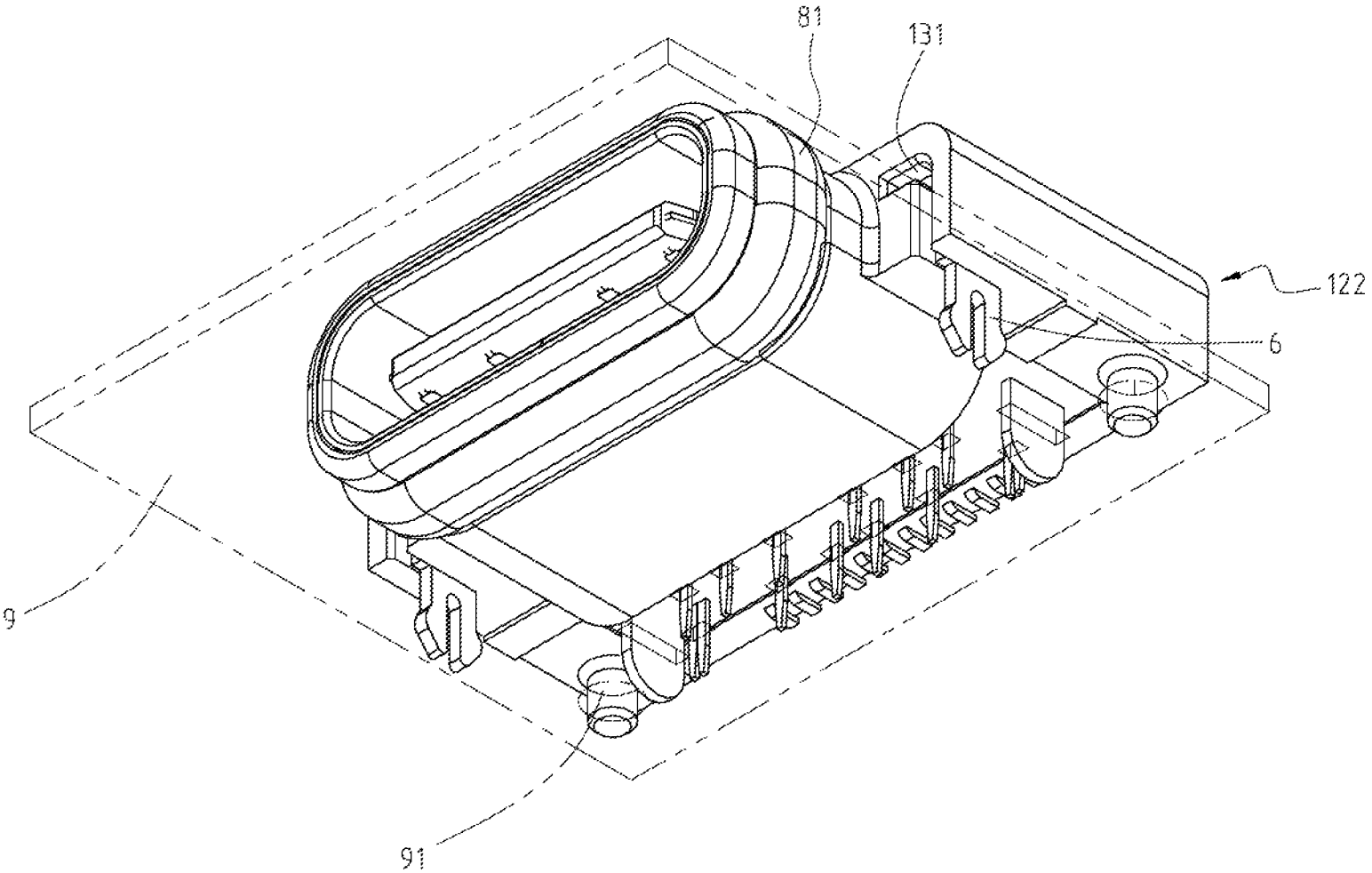
FIG. 1 illustrates a perspective view of a waterproof electrical receptacle connector according to a first embodiment of the instant disclosure.
Figure 2:
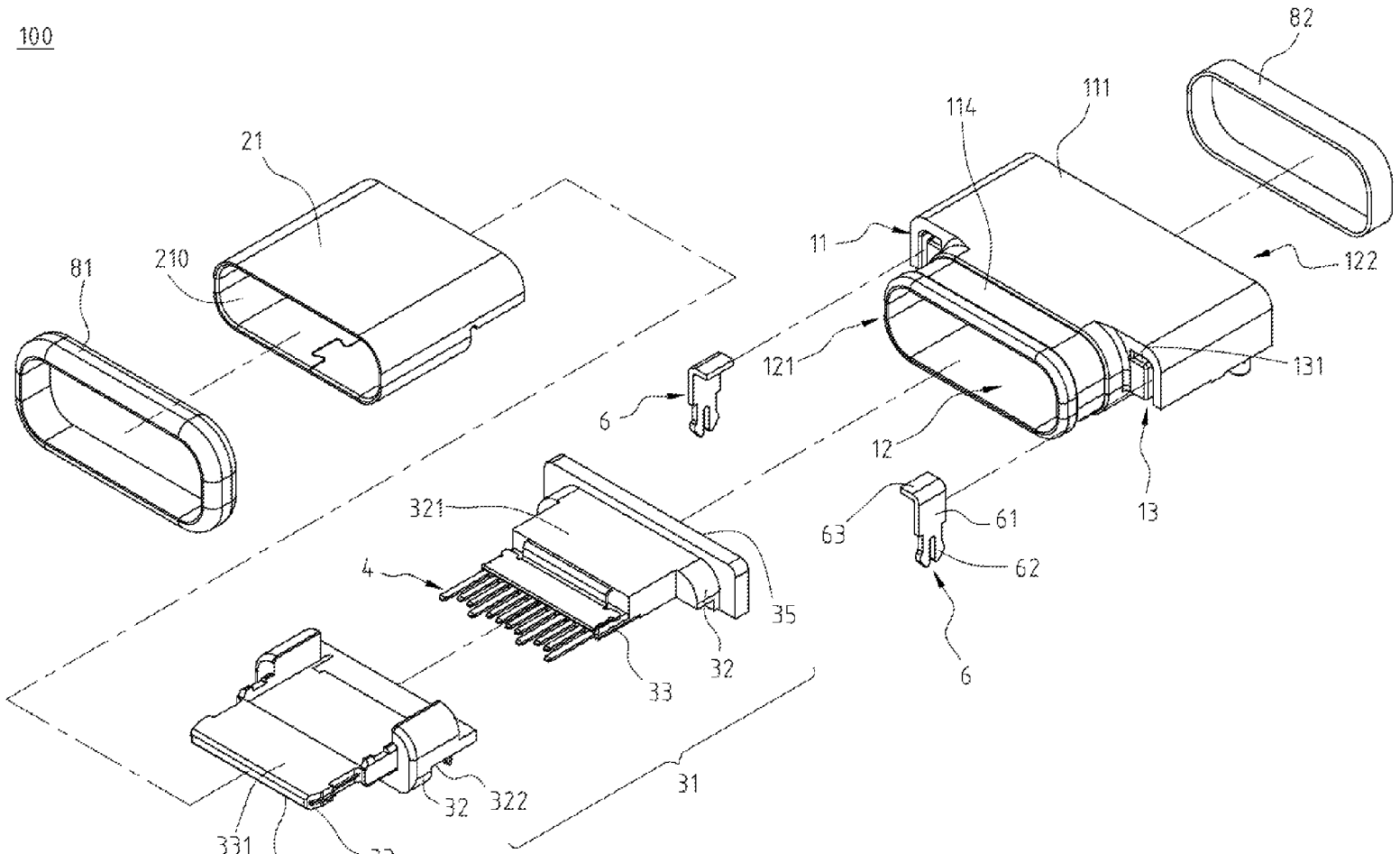
FIG. 2 illustrates an exploded view of the waterproof electrical receptacle connector of the first embodiment.
Figure 3:
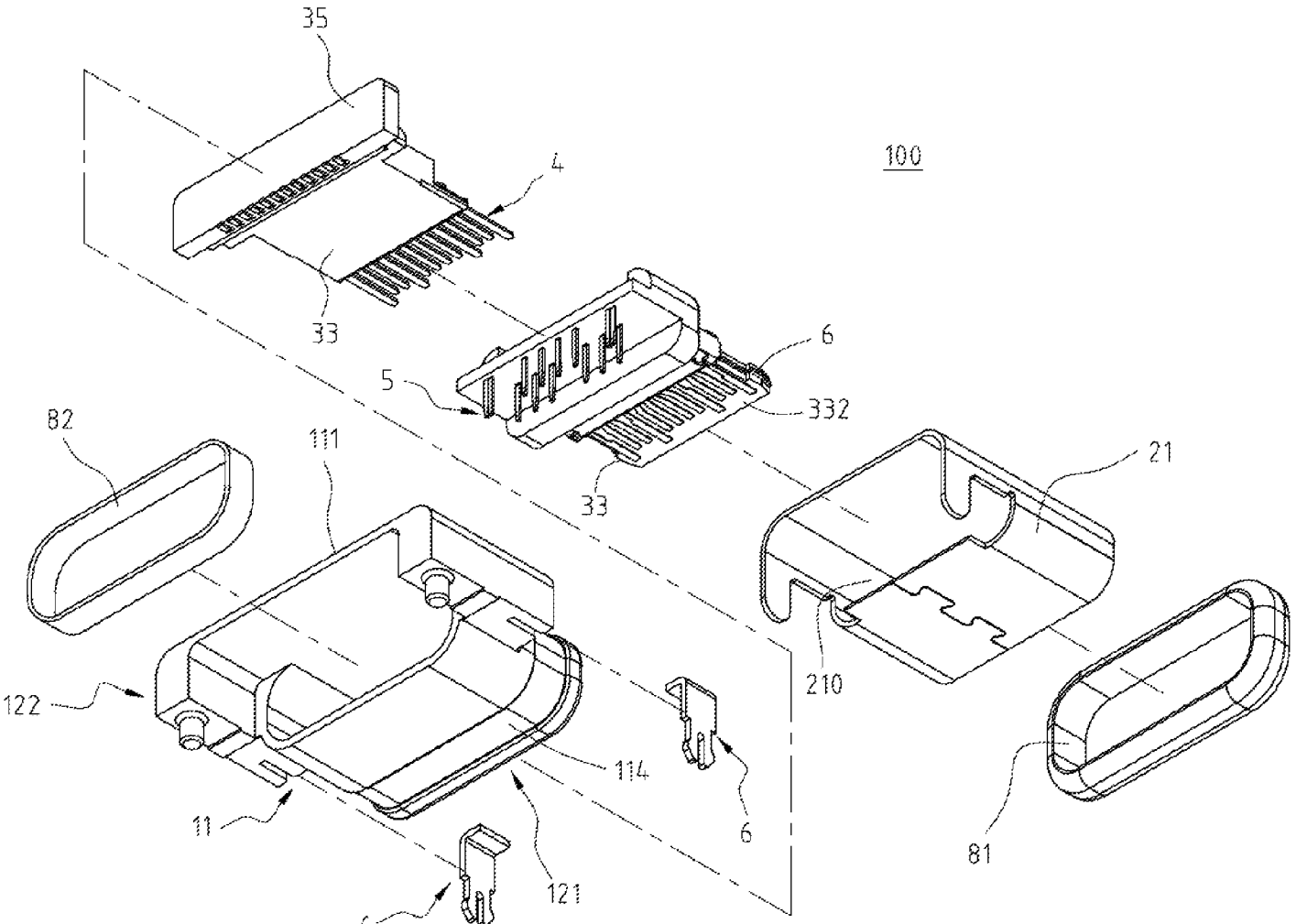
FIG. 3 illustrates an exploded view from the back of the waterproof electrical receptacle connector of the first embodiment.

Please refer to FIGS. 1 to 3, which illustrate a waterproof electrical receptacle connector 100 of a first embodiment according to the instant disclosure. FIG. 1 illustrates a perspective view of the waterproof electrical receptacle connector 100. FIG. 2 illustrates an exploded view of the waterproof electrical receptacle connector 100. FIG. 3 illustrates an exploded view from the back of the waterproof electrical receptacle connector 100. In this embodiment, the waterproof electrical receptacle connector 100 can provide a reversible or dual orientation USB Type-C connector interface and pin assignments, i.e., a USB Type-C receptacle connector. The waterproof electrical receptacle connector 100 can be utilized in mobile devices, laptop computers, digital cameras, or other electronic devices. In this embodiment, the waterproof electrical receptacle connector 100 comprises a plastic shell 11, a metallic shell 21, an insulated housing 31, a plurality of upper-row receptacle terminals 4, a plurality of lower-row receptacle terminals 5, and at least one buckling member 6.

In addition, the waterproof electrical receptacle connector 100 further comprises a grounding plate 16 disposed in the insulated housing 31 and located between the upper-row receptacle terminals 4 and the lower-row receptacle terminals 5. Specifically, the waterproof electrical receptacle connector 100 may have receptacle terminals aligned in one row. In other words, the waterproof electrical receptacle connector 100 may only have the upper-row receptacle terminals 4 or the lower-row receptacle terminals 5. In this embodiment, the waterproof electrical receptacle connector 100 comprises both the upper-row receptacle terminals 4 and the lower-row receptacle terminals 5, but embodiments are not limited thereto. The waterproof electrical receptacle connector 100 may have receptacle terminals aligned in one row according to practical requirements or cost consideration.

Please refer to FIGS. 1 to 3. The plastic shell 11 is a hollowed shell made of plastic. The plastic shell 11 comprises a shell body 111, a through hole 12, and at least one assembling hole 13. The through hole 12 is defined in the shell body 11. The assembling hole 12 is defined on the shell body 11. In this embodiment, the plastic shell 11 comprises several assembling holes 13, but embodiments are not limited thereto. In addition, the front and the rear of the plastic shell 11 respectively define an inserting end 121 and a sealed end 122. The two openings of the through hole 12 are near to the front of the inserting end 121 and the rear of the sealed end 122, respectively. The inserting end 121 is provided for mating with an electrical plug connector, the sealed end 122 is provided for receiving a sealing member 72, and the bottom of the plastic shell 11 may be provided for being assembled with a circuit board 9. The assembling holes 13 are defined at two sides of the shell body 111. Each of the assembling holes 13 is recessed from the inserting end 121 to the sealed end 122 and from the bottom of the shell body 111 to the top of the shell body 111. In this embodiment, the shell body 111 comprises engaging slots 131 communicating with the assembling holes 13 respectively, i.e., one by one. The engaging slots 131 are transversely defined on the shell body 111, so that each of the assembling holes 13 and the corresponding engaging slot 131 form an upside-down L profile. In addition, the assembling holes 13 are open at the bottom of the shell body 111.

Figure 7A:
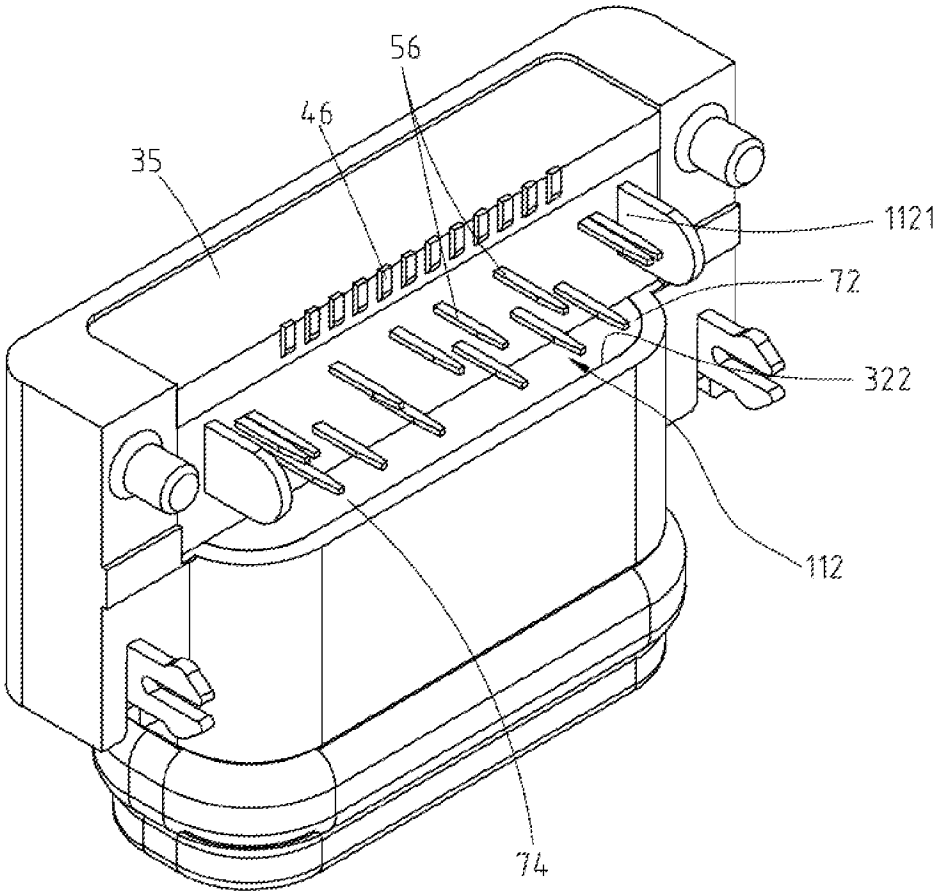
FIG. 7A illustrates a standing perspective view of the waterproof electrical receptacle connector.
Figure 7B:
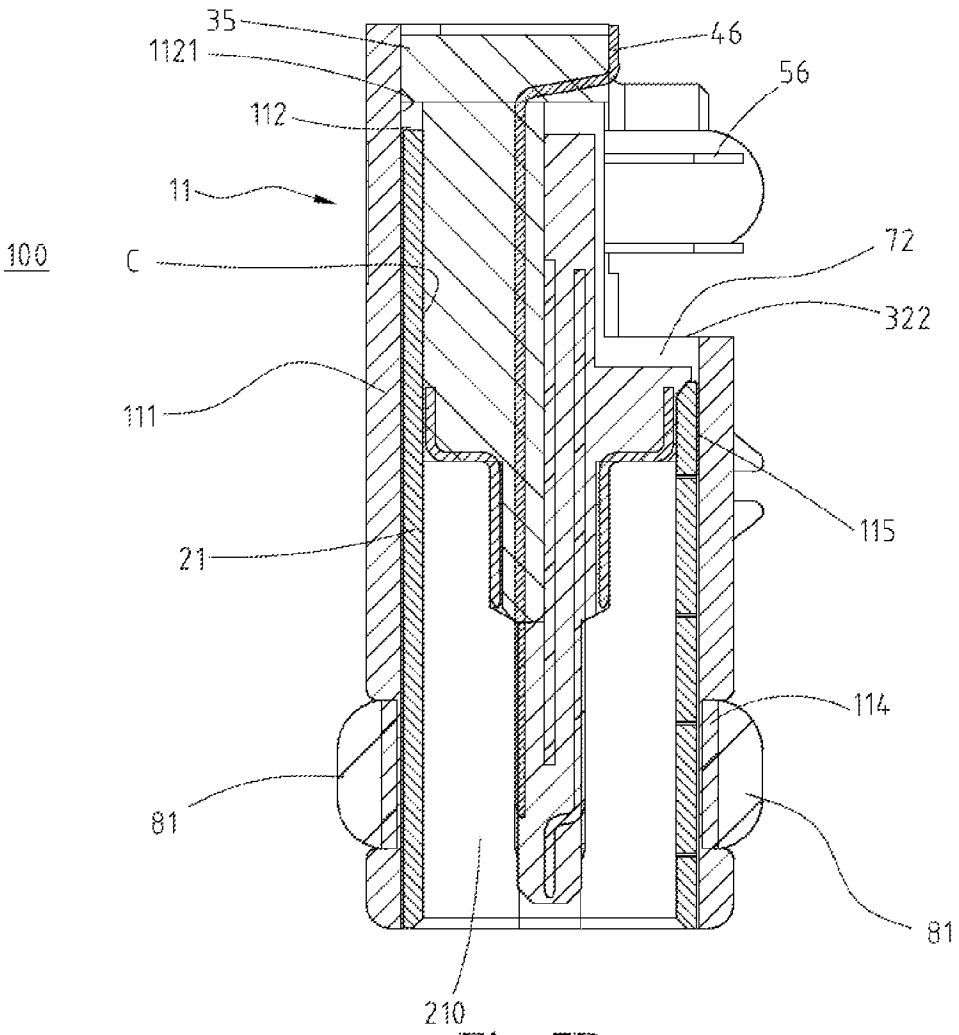
FIG. 7B illustrates a standing sectional view of the waterproof electrical receptacle connector.

Please refer to FIG. 2, FIG. 3, and FIG. 7B. In this embodiment, the plastic shell 11 comprises a rear lid and a filling section 112. The rear lid is approximately formed as upside-down U-shaped. The rear lid is extending from the rear of the plastic shell 11 and located at the top and the two sides of the sealed end 122. In other words, the bottom of the rear of the plastic shell 11 is not enclosed by the rear lid like an opening room/space. The inserting end 121 communicates with the interior of the rear lid through the through hole 12 and the sealed end 122. Accordingly, when the base portion 32 of the insulated housing 31 is assembled in the rear lid, the filling section 112 is located at the sealed end 122 and formed between the rear lid and the base portion 32 (as shown in FIG. 7B), and the filling section 112 is provided for receiving the sealing member 72.

Please refer to FIG. 2, FIG. 3, and FIG. 7B. The metallic shell 21 is a hollowed and tubular shell. The metallic shell 21 is received in the through hole 12. A first gap C is defined between the metallic shell 21 and the inner wall of the plastic shell 11, as shown in FIG. 7B. In addition, the metallic shell 21 defines a receiving cavity 210 therein. The metallic shell 21 encloses the base portion 32 and the tongue portion 33 of the insulated housing 31. The metallic shell 21 can be provided for reducing the electromagnetic interference when the upper-row receptacle terminals 4 and the lower-row receptacle terminals 5 are transmitting signals.

Please refer to FIG. 2, FIG. 3, and FIG. 7B. The insulated housing 31 is received in the receiving cavity 210. In addition, a second gap is defined between the insulated housing 31 and the inner wall of the metallic shell 21, as shown in FIG. 7B. The insulated housing 31 comprises a base portion 32 and a tongue portion 33. In this embodiment, the base portion 32 and the tongue portion 33 are respectively injection molded or the like. Moreover, the base portion 32 and the tongue portion 33 may be formed by a unitary member or a multi-piece member. In addition, the base portion 32 is located at the sealed end 122. The tongue portion 33 is extending from one side of the base portion 32 and further extending toward the inserting end 121. The tongue portion 33 has an upper surface 331 and a lower surface 332 opposite to the upper surface 331. In this embodiment, the top 321 of the base portion 32 is close to the inner wall of the rear lid, while the bottom 322 of the base portion 32 is exposed out of the bottom of the rear lid. Moreover, the insulated housing 31 further comprises a plastic block 35 extending from the rear of the base portion 32. The outer diameter of the plastic block 35 is greater than the outer diameter of the base portion 32, so that the plastic block 35 is located at the rear of the interior of the rear lid. The plastic block 35 is abutted against the inner wall of the rear lid, so that a gap is defined between the top of the base portion 32 and the inner wall of the rear lid. In other words, when the plastic block 35 is abutted against the inner wall of the rear lid, the plastic block 35, the rear lid, and the base portion 32 define an upside-down U-shaped filling passage 1121, and the filling passage 1121 is substantially defined by the filling section 112, and the filling passage 1121 is a passage provided for receiving the sealing member 72.

Figure 4:
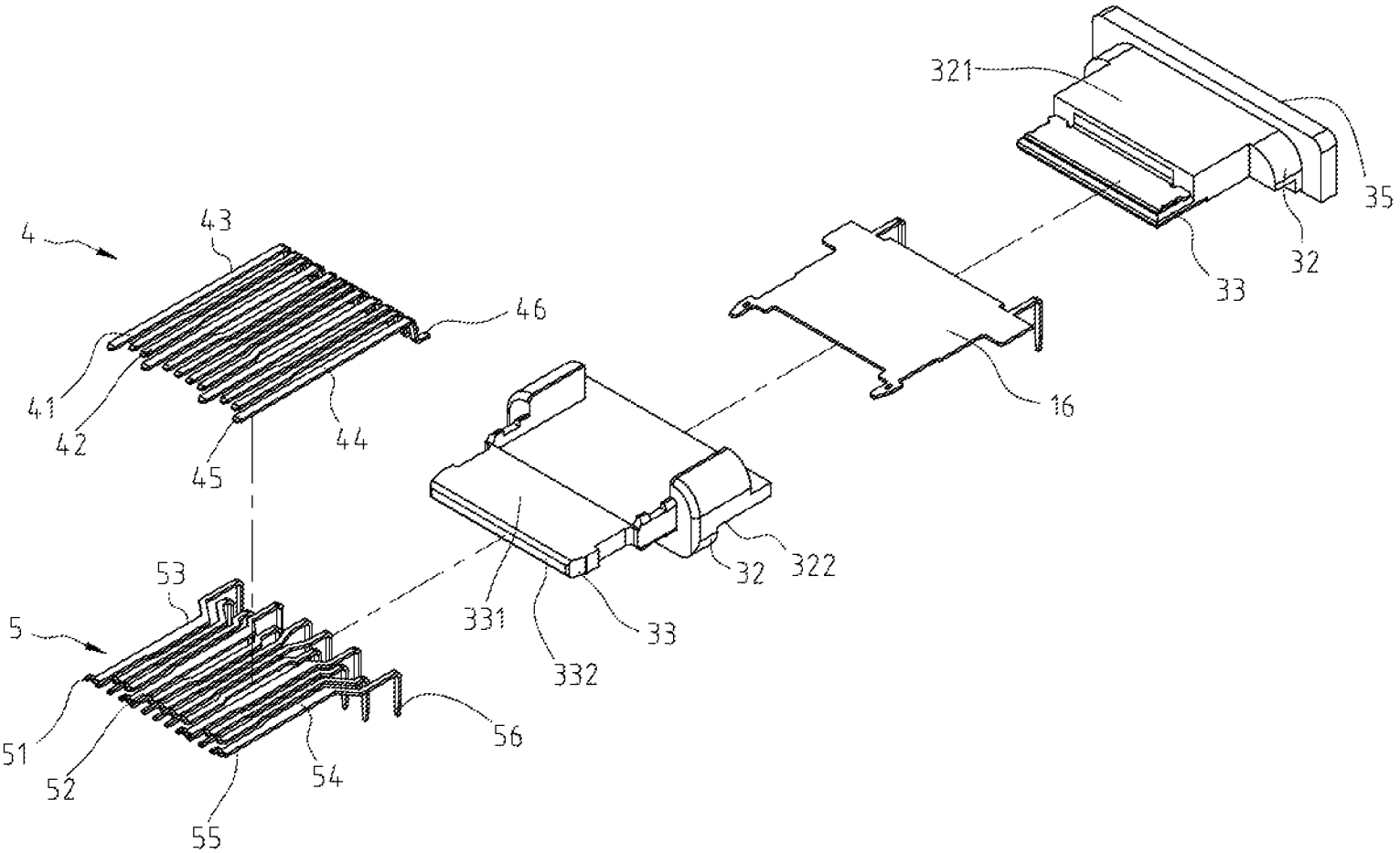
FIG. 4 illustrates an exploded view showing an insulated housing, a plurality of upper-row receptacle terminals, a plurality of lower-row receptacle terminals, and a grounding plate of the waterproof electrical receptacle connector of the first embodiment.
Figure 5:
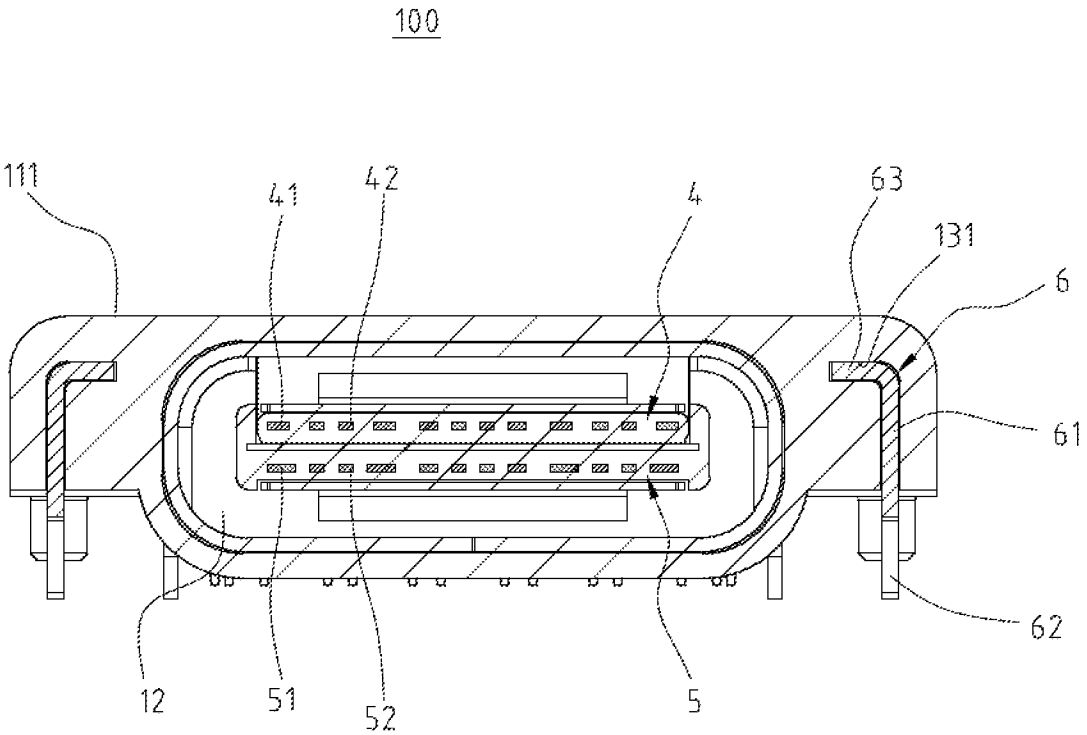
FIG. 5 illustrates a front sectional view of the waterproof electrical receptacle connector of the first embodiment.

Please refer to FIG. 4, FIG. 5, and FIG. 7B. The upper-row receptacle terminals 4 are held in the base portion 32 and the tongue portion 33. Each of the upper-row receptacle terminals 4 comprises a flat contact portion 45, a body portion 44, and a tail portion 46. The body portions 44 are held in the base portion 32 and disposed at the upper surface 331 of the tongue portion 33. For each of the upper-row receptacle terminals 4, the flat contact portion 45 is extending forward from the body portion 44 in the rear-to-front direction and partly exposed upon the upper surface 331 of the tongue portion 33, and the tail portion 46 is extending backward from the body portion 44 in the front-to-rear direction and protruded from the base portion 32. The upper signal pairs 41 are disposed at the upper surface 331 of the tongue portion 33 and provided for transmitting first signals (i.e., USB 3.0 signals). The tail portions 46 are protruded from the bottom of the base portion 32. Furthermore, the tail portions 46 are bent horizontally to form flat legs, named SMT (surface mounted technology) legs, which can be mounted or soldered on the surface of a printed circuit board (PCB) by using surface mount technology.

Please refer to FIG. 4, FIG. 5, and FIG. 7B. The lower-row receptacle terminals 5 are held in the base portion 32 and the tongue portion 33. The lower-row receptacle terminals 5 are spacedly aligned below the upper-row receptacle terminals 4. Each of the lower-row receptacle terminals 5 comprises a flat contact portion 55, a body portion 54, and a tail portion 56. The body portions 54 are held in the base portion 32 and disposed at the lower surface 332 of the tongue portion 33. For each of the lower-row receptacle terminals 5, the flat contact portion 55 is extending from the body portion 54 in the rear-to-front direction and partly exposed upon the lower surface 332 of the tongue portion 33, and the tail portion 56 is extending backward from the body portion 54 in the front-to-rear direction and protruded from the base portion 32. The lower signal pairs 51 are disposed at the lower surface 332 of the tongue portion 33 and provided for transmitting second signals (i.e., USB 3.0 signals). The tail portions 56 are protruded from the bottom of the base portion 32. In addition, the tail portions 56 are extending downwardly to form vertical legs, named through-hole legs, that are inserted into holes drilled in a printed circuit board (PCB) by using through-hole technology. In this embodiment, the tail portions 46, 56 are protruded out of the base portion 32 and arranged separately. For example, the tail portions 46, 56 may form three rows.

Please refer to FIGS. 4 to 6. In this embodiment, the upper-row receptacle terminals 4 comprise a plurality of upper signal pairs 41, at least one power terminal 42, and at least one ground terminal 43. As shown in FIG. 6, the upper-row receptacle terminals 4 comprise, from left to right, a ground terminal 43 (Gnd), a first upper signal pairs (TX1+−) 41, a second upper signal pairs (D+−) 41, and a third upper signal pairs (RX2+−) 41, two power terminals 42

(Power/VBUS) between the three pairs of upper signal pairs 41, a retain terminal (RFU) and another ground terminal 43 (Gnd). However, the pin assignments are not thus limited, and the example described here is only for illustrative purposes. In this embodiment, twelve upper-row receptacle terminals 4 are provided for transmitting USB 3.0 signals, but embodiments are not limited thereto. In some embodiments, the rightmost ground terminal 43 (or the leftmost ground terminal 43) and the retain terminal are omitted. Furthermore, the rightmost ground terminal 43 may be replaced by a power terminal 42 and provided for power transmission.

Please refer to FIGS. 4 to 6. In this embodiment, the lower-row receptacle terminals 5 comprise a plurality of lower signal pairs 51, at least one power terminal 52, and at least one ground terminal 53. As shown in FIG. 6, the lower-row receptacle terminals 5 comprise, from left to right, a ground terminal 53 (Gnd), a first lower signal pair (TX2+−) 51, a second lower signal pairs (D+−) 51, and a third lower signal pairs (RX1+−) 51, two power terminals 52 (Power/VBUS) between the three lower signal pairs 51, a retain terminal (RFU) and another ground terminal 53 (Gnd). However, the pin assignments are not thus limited, and the example described here is only for illustrative purposes. In this embodiment, twelve lower-row receptacle terminals 5 are provided for transmitting USB 3.0 signals, but embodiments are not limited thereto. In some embodiments, the rightmost ground terminal 53 (or the leftmost ground terminal 53) and the retain terminal are omitted. Furthermore, the rightmost ground terminal 53 may be replaced by a power terminal 52 and provided for power transmission.

In the forgoing embodiments, the receptacle terminals 4, 5 are provided for transmitting USB 3.0 signals, but embodiments are not limited thereto. In some embodiments, for the upper-row receptacle terminals 4 in accordance with transmission of USB 2.0 signals, the first upper signal pairs (TX1+−) 41 and the third upper signal pairs (RX2+−) 41 are omitted, and the second upper signal pairs (D+−) 41 and the power terminals (Power/VBUS) 42 are retained. While for the lower-row receptacle terminals 5 in accordance with transmission of USB 2.0 signals, the first lower signal pairs (TX2+−) 51 and the third lower signal pairs (RX1+−) 51 are omitted, and the second lower signal pairs (D+−) 51 and the power terminals (Power/VBUS) 52 are retained.

Please refer to FIGS. 4 to 6. In this embodiment, the upper-row receptacle terminals 4 and the lower-row receptacle terminals 5 are respectively disposed at the upper surface 331 and the lower surface 332 of the tongue portion 33. In this embodiment, as shown in FIG. 5 and FIG. 6, the position of the upper-row receptacle terminals 4 corresponds to the position of the lower-row receptacle terminals 5. Additionally, pin-assignments of the upper-row receptacle terminals 4 and the lower-row receptacle terminals 5 are point-symmetrical with a central point of the receiving cavity 210 as the symmetrical center. In other words, pin-assignments of the upper-row receptacle terminals 4 and the lower-row receptacle terminals 5 have 180 degree symmetrical design with respect to the central point of the receiving cavity 210 as the symmetrical center. The dual or double orientation design enables an electrical plug connector to be inserted into the waterproof electrical receptacle connector 100 in either of two intuitive orientations, i.e., in either upside-up or upside-down directions. Here, point-symmetry means that after the upper-row receptacle terminals 4 (or the lower-row receptacle terminals 5), are rotated by 180 degrees with the symmetrical center as the rotating center, the upper-row receptacle terminals 4 and the lower-row receptacle terminals 5 are overlapped. That is, the rotated upper-row receptacle terminals 4 are arranged at the position of the original lower-row receptacle terminals 5, and the rotated lower-row receptacle terminals 5 are arranged at the position of the original upper-row receptacle terminals 4. In other words, the upper-row receptacle terminals 4 and the lower-row receptacle terminals 5 are arranged upside down, and the pin assignments of the flat contact portions 45 are left-right reversal with respect to that of the flat contact portions 55. An electrical plug connector is inserted into the waterproof electrical receptacle connector 100 with a first orientation where the upper surface 331 is facing up, for transmitting first signals. Conversely, the electrical plug connector is inserted into the waterproof electrical receptacle connector 100 with a second orientation where the upper surface 331 is facing down, for transmitting second signals. Furthermore, the specification for transmitting the first signals is conformed to the specification for transmitting the second signals. Note that, the inserting orientation of the electrical plug connector is not limited by the waterproof electrical receptacle connector 100 according embodiments of the instant disclosure.

Please refer to FIG. 2, FIG. 3, and FIG. 5. In this embodiment, the waterproof electrical receptacle connector 100 comprises a plurality of buckling members 6, but embodiments are not limited thereto. In some embodiments, the waterproof electrical receptacle connector 100 may comprise one buckling member 6. In detail, in such embodiments, the plastic shell 11 defines one assembling hole 13, and the buckling member 6 is positioned with the assembling hole 13, so that the waterproof electrical receptacle connector 100 can be stably assembled with a circuit board 9 via the buckling member 6.

Please refer to FIGS. 1 to 3 and FIG. 5. In this embodiment, the buckling members 6 are assembled with the assembling holes 13 from the front of the plastic shell 11, and the assembling method described above is only an illustrative purpose. In some embodiment, the buckling member 6 may be assembled with the plastic shell 11 by injection molding technique or the like. In addition, the buckling member 6 comprises a buckling body 61 and a hook portion 62. The buckling body 61 is strip shaped. The hook portion 62 is extending from the bottom of the buckling body 61 and protruded out of the assembling hole 13. In this embodiment, the hook portion 62 comprises two claws and a groove between the two claws. When the two claws of the hook portion 62 is inserted into a buckling hole 91 of the circuit board 9, the two claws are slightly deflected toward the groove. When the two claws are passing through and protruded from the buckling hole 91, the two claws are moved resiliently so that the two claws are engaged with the outer wall of the buckling hole 91. Therefore, the hook portion 62 can be positioned with the circuit board 9. In this embodiment, the two claws are symmetrical with respect to each other using an axis parallel to the length direction of the groove as a reference line, and the end portion of each of the claws are wider than the neck portion of the claw, but embodiments are not limited thereto. In some embodiments, the hook portion 62 may be devoid of the groove. In addition, the buckling member 6 may be assembled with the assembling hole 13 by closely mating with the assembling hole 13. In a further option, the waterproof electrical receptacle connector 100 may further comprise a glue filling member 71 filled in the assembling hole 13 to position with the buckling member 6, so that the buckling member 6 can be prevented from being detached off the assembling hole 13. Accordingly, the buckling member 6 can be firmly positioned with the assembling hole 13.

Please refer to FIG. 1. The circuit board 9 comprises at least one buckling hole 91 positioned with the hook portion 62. In other words, when the circuit board 9 is assembled on the bottom of the plastic shell 11, the hook portion 62 of the buckling member 6 is passing through the buckling hole 91 of the circuit board 9 and engaged with the outer wall of the buckling hole 91. Moreover, in this embodiment, the buckling member 6 comprises a transverse plate 63 which is extending from the top of the buckling body 61 along the width direction of the buckling body 61 and is perpendicular to the buckling body 61. When the buckling member 6 is assembled into the assembling hole 13 from the inserting end 121 of the plastic shell 11, the transverse plate 63 is positioned with the engaging slot 131, so that the buckling member 6 would not detach off the assembling hole 13 easily.

Figure 8:
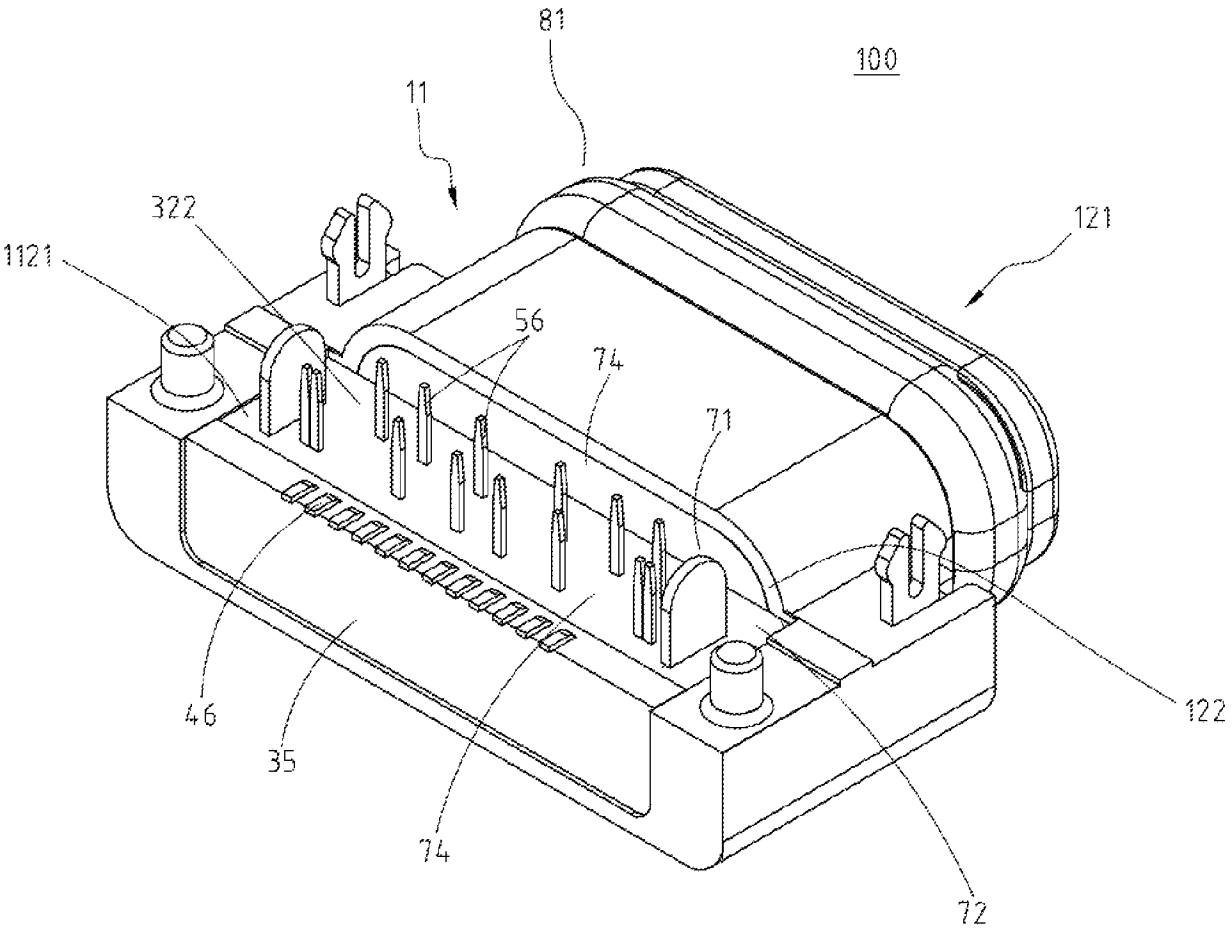
FIG. 8 illustrates a laid sectional view of the waterproof electrical receptacle connector.

Please refer to FIG. 7A, FIG. 7B, and FIG. 8. The waterproof electrical receptacle connector 100 further comprises a sealing member 72. The sealing member 72 is a waterproof glue block 74 formed by drying and solidifying a liquid. In this embodiment, before the sealing member 72 is dried and set, the sealing member 72 is filled in the sealed end 122 of the plastic shell 11, and it is also filled in the second gap between the plastic shell 11 and the metallic shell 21. In addition, the sealing member 72 is also filled in the first gap C between the metallic shell 21 and the inner wall of the plastic shell 11. Therefore, after the sealing member 72 is dried and set, the sealing member 72 can prevent water moist stayed at the inserting end 121 of the plastic shell 11 from penetrating into the sealed end 122 through the through hole 12. In other words, when the waterproof electrical receptacle connector 100 is assembled to an electronic device, water moist cannot enter into the electronic device through the waterproof electrical receptacle connector 100 and would not affect the operation of electronic components on a circuit board of the electronic device.

Please refer to FIG. 7A, FIG. 7B, and FIG. 8. In this embodiment, a first glue dispensing procedure is applied. In this embodiment, the sealing member 72 comprises a first sealing portion formed at the bottom 322 of the base portion 32. Specifically, the first sealing portion is formed at the area around the bottom 322 of the base portion 32 near the second gap. In this embodiment, to perform the first glue dispensing procedure, firstly the waterproof electrical receptacle connector 100 is stood, i.e., the inserting end 121 is at the bottom and the sealed end 122 is at the top. Then, the sealing member 72 in liquid state (i.e., uncured sealing member 72) is filled in the bottom 322 of the base portion 32, and the liquid sealing member 72 is further flowed into the second gap, so that the bottom 322 of the base portion 32 and the second gap are filled by the liquid sealing member 72. After the liquid sealing member 72 is flowed into the second gap, a dry procedure can be applied to the connector, so that the liquid sealing member 72 becomes a solidified waterproof glue block 74 formed at the sealed end 122, and the bottom 322 of the base portion 32 and the second gap are filled by the waterproof glue block 74. Therefore, a first level of waterproof function between the plastic shell 11 and the metallic shell 21 is provided. In addition, after solidification, the sealing member 72 becomes the solidified waterproof glue block 74, thus the first sealing portion 71 of the sealing member 72 would not be moved freely with respect to the sealed end 122 and prevents the gap being exposed.

Please refer to FIG. 7A, FIG. 7B, and FIG. 8. After the first glue dispensing procedure is completed, a second glue dispensing procedure is applied. Prior to the second glue dispensing procedure, the back of the waterproof electrical receptacle connector 100 is flipped to the front. In other words, the tail portions 46, 56 are upward standing, and the connector is in a laid configuration. And then, the sealing member 72 in liquid state (i.e., uncured sealing member 72) is filled in the bottom 322 of the base portion 32 and the filling section 112. In this embodiment, the sealing member 72 comprises a second sealing portion. The second sealing portion is formed at the bottom 322 of the base portion 32 from which the lower-row receptacle terminals 5 are exposed and formed at the filling section 112. Specifically, the second sealing portion is formed at the bottom 322 of the base portion 32 from which the second tail portions 56 are exposed. Then, the liquid sealing member 72 is flowed to the filling passage 1121 defined by the filling section 112 along the bottom 322 of the base portion 32, so that the sealing member 72 fills in the space between the tail portions 56 and the base portion 32 and fills in the filling passage 1121. Therefore, a second level of waterproof function is provided between the tail portions 56 and the base portion 32 and in the filling passage 1121. In this embodiment, two times of glue dispensing procedures are applied to the connector to achieve the waterproof function, but embodiments are not limited thereto. In some embodiments, three or more times of glue dispensing procedures may be applied to the connector for achieving better waterproof function.

In this embodiment, when the tail portions 56 are combined with the base portion 32 by means of assembling, the glue dispensing procedures can provide the waterproof function. In other words, the base portion 32 defines a plurality of terminal grooves for assembling the tail portions 56 respectively. After the tail portions 56 are assembled to terminal grooves of the base portion 32, a gap may be defined between each of the tail portions 56 and the corresponding terminal groove. Therefore, the sealing member 72 can be filled into the gaps and prevents water moist at the inserting end 121 from penetrating into the sealed end 122 through the gap between each of the tail portions 56 and the corresponding terminal groove.

In the foregoing embodiment, the base portion 32 has the terminal grooves for passing through the lower-row receptacle terminals 5, but embodiments are not limited thereto. Alternatively, according to some embodiments of the waterproof electrical receptacle connector 100, the insulated housing 31 may be integrally formed with the upper-row receptacle terminals 4 and the lower-row receptacle terminals 5. The insulated housing 31, the upper-row receptacle terminals 4, and the lower-row receptacle terminals 5 may be formed integrally by means of insert-molding, over-molding, a combination thereof, or the like. In the embodiment, the insulated housing 31 does not have the terminal grooves, and the upper-row receptacle terminals 4 and the lower-row receptacle terminals 5 are directly passing through the base portion 32. During a thermal procedure of the manufacturing of the waterproof electrical receptacle connector 100, e.g., heating in the flow convection oven, gaps may be formed among the metallic receptacle terminals 4, 5 and the plastic insulated housing 31 because of their different thermal expansion coefficients. Therefore, the waterproof function of the connector is not sufficient then. Thus, the sealing member 72 (e.g. the waterproof glue block 74) may be applied to the waterproof electrical receptacle connector 100, formed at the sealed end 122, and filled in the gaps inside the connector to improve the waterproof function of the connector.

Please refer to FIG. 1, FIG. 2, and FIG. 7B. In this embodiment, the waterproof electrical receptacle connector 100 further comprises a first waterproof gasket 81. The first waterproof gasket 81 is an O-shaped plastic gasket, and the plastic shell 11 further comprises an outer recessed portion 114 at the inserting end 121. The first waterproof gasket 81 is fitted over the outer recessed portion 114. Accordingly, when the waterproof electrical receptacle connector 100 is assembled to a casing of an electronic device, the first waterproof gasket 81 is abutted against the inner wall of the casing, so that water moist can be prevented from entering into the casing through the gap between the plastic shell 11 and the casing.

Please refer to FIG. 2, FIG. 3, and FIG. 7B. In this embodiment, the waterproof electrical receptacle connector 100 further comprises a second waterproof gasket 82. The second waterproof gasket 82 is an O-shaped plastic gasket. The second waterproof gasket 82 is disposed at the sealed end 122 and located in the through hole 12. The second waterproof gasket 82 is abutted against the inner wall of the plastic shell 11 and the outer wall of the metallic shell 21, so that the second waterproof gasket 82 can prevent water moist from entering into the connector from the gap between the plastic shell 11 and the metallic shell 21. In this embodiment, the plastic shell 11 comprises an inward recessed portion 115 formed at the inner wall of the plastic shell 11 and located at the sealed end 122. The second waterproof gasket 82 is disposed in the inward recessed portion 115 and positioned by the inward recessed portion 115.

Figure 9:
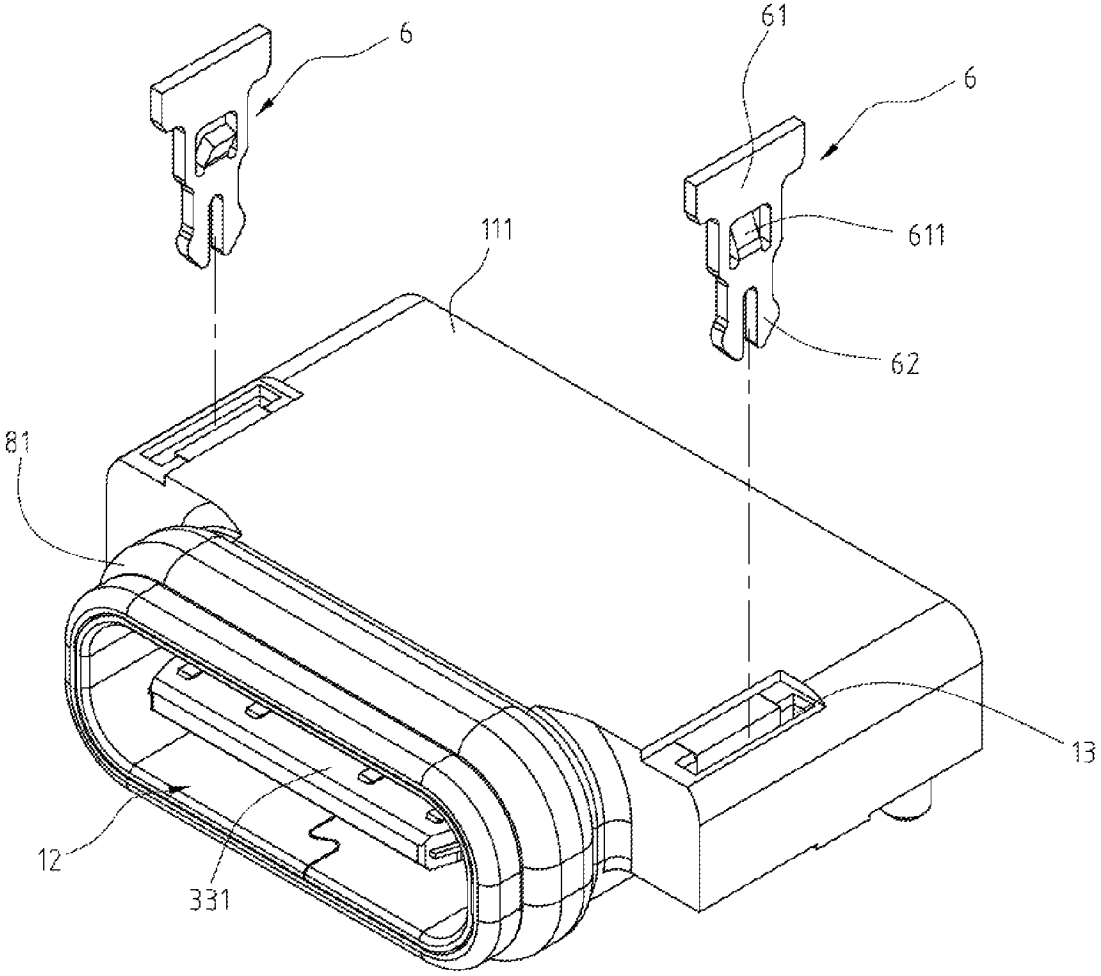
FIG. 9 illustrates an exploded view of a waterproof electrical receptacle connector according to a second embodiment of the instant disclosure.
Figure 10:
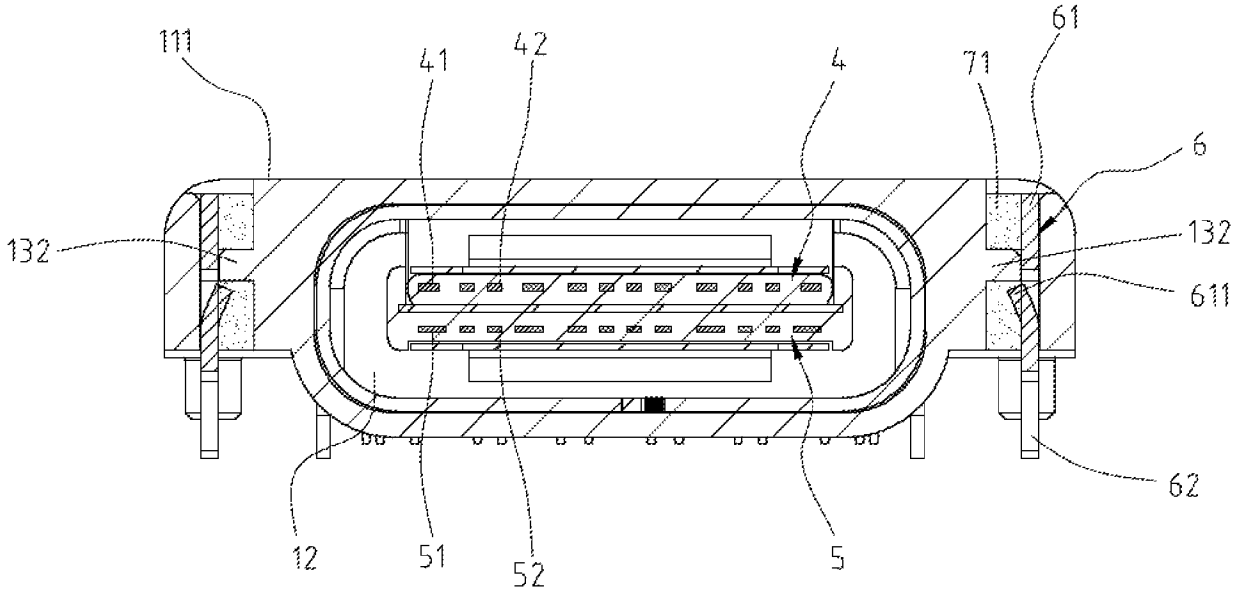
FIG. 10 illustrates a front sectional view of the waterproof electrical receptacle connector of the second embodiment.

Please refer to FIGS. 9 and 10, which illustrate a waterproof electrical receptacle connector 100 of a second embodiment of the instant disclosure. In the second embodiment, the assembling hole 13 is defined through the plastic shell 11 from the top to the bottom, which is different from the assembling hole 13 illustrated in the first embodiment. In this embodiment, the buckling member 6 is inserted into the assembling hole 13 from the top of the plastic shell 11, so that the buckling member 6 is assembled with the plastic shell 11, but embodiments are not limited thereto. In some embodiments, the buckling member 6 may be formed with the plastic shell 11 by injection molding technique or the like. In this embodiment, the buckling member 6 comprises an engaging block 611 extending outward from the buckling body 61, and the shell body 111 of the plastic shell 11 comprises a protruded block 132 defined in the assembling hole 13 to engage with the engaging block 611. Therefore, the buckling member 6 can be prevented from being detached off the plastic shell 11 from the upper opening of the assembling hole 13 (i.e., the opening of the assembling hole 13 on the top of the plastic shell 11). In addition, the width of the buckling body 61 is greater than the diameter of the lower opening of the assembling hole 13 (i.e., the opening of the assembling hole 13 on the bottom of the plastic shell 11), so that the buckling member 6 can be prevented from being detached off the plastic shell 11 from the lower opening of the assembling hole 13. In this embodiment, the waterproof electrical receptacle connector 100 may further comprise a glue filling member 71 filled in the assembling hole 13 to position with the buckling member 6. Accordingly, the buckling member 6 can be firmly positioned with the assembling hole 13.

Based on the above, the buckling member is assembled in the assembling hole of the plastic shell, and the hook portion of the buckling member is protruded out of the assembling hole to be engaged with the buckling hole of the circuit board, so that the circuit board can be firmly positioned with the waterproof electrical receptacle connector. Accordingly, when the waterproof electrical receptacle connector suffers an impact force, the waterproof electrical receptacle connector would not be bent. As a result, a user can mate an electrical plug connector with the waterproof electrical receptacle connector inside an electronic device rapidly and conveniently.

In addition, several waterproof gaskets are fitted over the plastic shell and abutted against the inner wall of the electronic device assembled with the waterproof electrical receptacle connector, so that water moist cannot enter into the electronic device through the gaps between the plastic shell and the metallic shell. Moreover, the waterproof gasket is abutted between the inner wall of the plastic shell and the outer wall of the metallic shell to prevent water moist from entering into the connector through the gap between the plastic shell and the metallic shell. Consequently, water moist can be efficiently prevented from entering into the electronic device assembled with the connector.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the waterproof electrical receptacle connector can have a 180 degree symmetrical, dual or double orientation design and pin assignments which enables the waterproof electrical receptacle connector to be mated with a corresponding plug connector in either of two intuitive orientations, i.e. in either upside-up or upside-down directions. Therefore, when an electrical plug connector is inserted into the waterproof electrical receptacle connector with a first orientation, the flat contact portions of the upper-row receptacle terminals are in contact with upper-row plug terminals of the electrical plug connector. Conversely, when the electrical plug connector is inserted into the waterproof electrical receptacle connector with a second orientation, the flat contact portions of the lower-row receptacle terminals are in contact with the upper-row plug terminals of the electrical plug connector. Note that, the inserting orientation of the electrical plug connector is not limited by the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A waterproof electrical receptacle connector, comprising:

a plastic shell comprising a shell body, a through hole, and at least one assembling hole, wherein the through hole is defined in the shell body, the assembling hole is defined on the shell body;

a metallic shell received in the through hole of the shell body, wherein the metallic shell defines a receiving cavity;

an insulated housing received in the receiving cavity, wherein the insulated housing comprises a base portion and a tongue portion, the tongue portion is extending from one side of the base portion, the tongue portion has an upper surface and a lower surface opposite to the upper surface;

a plurality of upper-row receptacle terminals held in the insulated housing and disposed at the upper surface, wherein the upper-row receptacle terminals comprise a plurality of upper signal pairs, at least one power terminal, and at least one ground terminal;

a plurality of lower-row receptacle terminals held in the insulated housing and disposed at the lower surface, wherein the lower-row receptacle terminals comprise a plurality of lower signal pairs, at least one power terminal, and at least one ground terminal;

at least one buckling member received in the assembling hole, wherein the buckling member comprises a buckling body and a hook portion extending from the bottom of the buckling body and protruded out of the assembling hole;

a first waterproof gasket fitted over the plastic shell; and a second waterproof gasket received in the through hole and abutted between the inner wall of the plastic shell and the outer wall of the metallic shell, wherein the second waterproof gasket is an O-shaped plastic gasket.

2. The waterproof electrical receptacle connector according to claim 1, wherein the shell body further comprises an engaging slot, the engaging slot communicates with the assembling hole, the buckling member comprises a transverse plate extending from the top of the buckling body along the width direction of the buckling body and perpendicular to the buckling body, wherein the transverse plate is received in the engaging slot.

3. The waterproof electrical receptacle connector according to claim 1, wherein the buckling member comprises an engaging block extending outward from the buckling body, the shell body comprises a protruded block defined in the assembling hole to engage with the engaging block.

4. The waterproof electrical receptacle connector according to claim 1, further comprising a glue filling member filled in the assembling hole to position with the buckling member.

5. The waterproof electrical receptacle connector according to claim 1, further comprising a circuit board assembled at the bottom of the plastic shell, wherein the circuit board comprises at least one buckling hole positioned with the hook portion.

6. The waterproof electrical receptacle connector according to claim 1, further comprising a sealing member filled in the rear of the plastic shell to fill a gap between the plastic shell and the metallic shell and to fill the bottom of the base portion.

7. The waterproof electrical receptacle connector according to claim 1, wherein the upper-row receptacle terminals and the lower-row receptacle terminals have 180 degree symmetrical design with respect to a central point of the receiving cavity as the symmetrical center.

8. The waterproof electrical receptacle connector according to claim 1, wherein the position of the upper-row receptacle terminals corresponds to the position of the lower-row receptacle terminals.

9. The waterproof electrical receptacle connector according to claim 1, further comprising a grounding plate disposed at the insulated housing and between the upper-row receptacle terminals and the lower-row receptacle terminals.

10. A waterproof electrical receptacle connector, comprising:

a plastic shell comprising a shell body, wherein a through hole is defined in the shell body, a front and a rear of the plastic shell respectively are as an inserting end and a sealed end, two assembling holes are recessed on the shell body from the inserting end to the sealed end and from a bottom of the shell body to a top of the shell body at two sides of the shell body, two engaging slots are transversely recessed from the inserting end to the sealed end on the shell body, and each of the assembling holes and the corresponding engaging slots form an upside-down L profile;

a metallic shell received in the through hole of the shell body, wherein the metallic shell defines a receiving cavity;

an insulated housing received in the receiving cavity, wherein the insulated housing comprises a base portion and a tongue portion, the tongue portion is extending from one side of the base portion, the tongue portion has an upper surface and a lower surface opposite to the upper surface;

a plurality of upper-row receptacle terminals held in the insulated housing and disposed at the upper surface, wherein the upper-row receptacle terminals comprise a plurality of upper signal pairs, at least one power terminal, and at least one ground terminal;

a plurality of lower-row receptacle terminals held in the insulated housing and disposed at the lower surface, wherein the lower-row receptacle terminals comprise a plurality of lower signal pairs, at least one power terminal, and at least one ground terminal;

two buckling members respectively received in the corresponding assembling holes and the corresponding engaging slots, wherein the buckling member comprises a buckling body, a hook portion extending from the bottom of the buckling body and protruded out of the assembling hole, and a transverse plate extending from the top of the buckling body along the width direction of the buckling body and perpendicular to the buckling body, wherein each of the transverse plates is received the corresponding engaging slot and each of the buckling bodies is received in the corresponding assembling hole.

11. The waterproof electrical receptacle connector according to claim 10, further comprising:

a first waterproof gasket fitted over the plastic shell; and a second waterproof gasket received in the through hole and abutted between the inner wall of the plastic shell and the outer wall of the metallic shell, wherein the second waterproof gasket is an O-shaped plastic gasket.

12. The waterproof electrical receptacle connector according to claim 10, further comprising a circuit board assembled at the bottom of the plastic shell, wherein the circuit board comprises at least one buckling hole positioned with the hook portion.

13. The waterproof electrical receptacle connector according to claim 10, further comprising a sealing member filled in the rear of the plastic shell to fill a gap between the plastic shell and the metallic shell and to fill the bottom of the base portion.

14. The waterproof electrical receptacle connector according to claim 10, wherein the upper-row receptacle terminals and the lower-row receptacle terminals have 180 degree symmetrical design with respect to a central point of the receiving cavity as the symmetrical center.

15. A waterproof electrical receptacle connector, comprising:

a plastic shell comprising a shell body, wherein a through hole is defined in the shell body, two assembling holes are through the shell body from a top of the shell body to a bottom of the shell body at two sides of the shell body;

a metallic shell received in the through hole of the shell body, wherein the metallic shell defines a receiving cavity;

an insulated housing received in the receiving cavity, wherein the insulated housing comprises a base portion and a tongue portion, the tongue portion is extending from one side of the base portion, the tongue portion has an upper surface and a lower surface opposite to the upper surface;

a plurality of upper-row receptacle terminals held in the insulated housing and disposed at the upper surface, wherein the upper-row receptacle terminals comprise a plurality of upper signal pairs, at least one power terminal, and at least one ground terminal;

a plurality of lower-row receptacle terminals held in the insulated housing and disposed at the lower surface, wherein the lower-row receptacle terminals comprise a plurality of lower signal pairs, at least one power terminal, and at least one ground terminal;

two buckling members respectively received in the corresponding assembling holes, wherein the buckling member comprises a buckling body and a hook portion extending from the bottom of the buckling body and protruded out of the assembling hole.

16. The waterproof electrical receptacle connector according to claim 15, further comprising:

a first waterproof gasket fitted over the plastic shell; and a second waterproof gasket received in the through hole and abutted between the inner wall of the plastic shell and the outer wall of the metallic shell, wherein the second waterproof gasket is an O-shaped plastic gasket.

17. The waterproof electrical receptacle connector according to claim 15, further comprising a circuit board assembled at the bottom of the plastic shell, wherein the circuit board comprises at least one buckling hole positioned with the hook portion.

18. The waterproof electrical receptacle connector according to claim 15, further comprising a sealing member filled in the rear of the plastic shell to fill a gap between the plastic shell and the metallic shell and to fill the bottom of the base portion.

19. The waterproof electrical receptacle connector according to claim 15, wherein the upper-row receptacle terminals and the lower-row receptacle terminals have 180 degree symmetrical design with respect to a central point of the receiving cavity as the symmetrical center.

* * * * *